US005909755A

United States Patent [19]

Leal

[11] Patent Number: 5,909,755

[45] Date of Patent: Jun. 8, 1999

[54] VACUUM DUST MOP

[76] Inventor: Margo Gene Leal, 2170 Bello Ave., San Jose, Calif. 95125

[21] Appl. No.: 08/939,297

[22] Filed: Sep. 29, 1997

[51] Int. Cl.[6] ..... A47L 5/24

[52] U.S. Cl. ..... 15/325; 15/329; 15/344; 15/347; 15/410

[58] Field of Search ..... 15/325, 328, 329, 15/344, 347, 410

[56] References Cited

U.S. PATENT DOCUMENTS

| | | | |
|---|---|---|---|
| D. 277,050 | 1/1985 | Bruseloff | D2/361 |
| 2,756,456 | 7/1956 | Harris | 15/344 |
| 3,516,110 | 6/1970 | Nilsson | 15/325 |
| 3,574,885 | 4/1971 | Jones | 15/402 |
| 3,903,564 | 9/1975 | Morinaga | 15/344 |
| 4,302,225 | 11/1981 | Eckart et al. | 15/344 |
| 4,577,365 | 3/1986 | Yuen | 15/344 |
| 4,653,137 | 3/1987 | Fleischhauer | 15/374 |
| 4,947,506 | 8/1990 | Foster | 15/325 |
| 4,989,292 | 2/1991 | Hwang | 15/347 |
| 5,107,568 | 4/1992 | Wade | 15/387 |
| 5,337,445 | 8/1994 | Harris et al. | 15/394 |
| 5,392,491 | 2/1995 | Hwang et al. | 15/322 |
| 5,394,588 | 3/1995 | Kweon et al. | 15/372 |

*Primary Examiner*—Elizabeth McKane
*Assistant Examiner*—Theresa T. Snider
*Attorney, Agent, or Firm*—Goldstein & Canino

[57] ABSTRACT

The invention is a lightweight vacuum device to be used on furnishings, floors and walls. The apparatus consists of a housing having suction slots on four sides and the bottom. A motor device sits within the housing and creates a vacuum which draws dust into the slots. A filter mechanism within the housing traps the dust for subsequent removal from the housing. The housing is covered by a soft cloth cover as not to scratch the surfaces to be cleaned. The cover has a plurality of holes on the side and bottom in order to allow the dust particles to access the suction slots and an internally sewed glove to allow the unit to be hand held. An appenditure on the top of the housing has internal threads in order to accept a broom handle to allow the unit to be easily used on floors and walls.

3 Claims, 3 Drawing Sheets

VACUUM DUST MOP

BACKGROUND OF THE INVENTION

The invention relates to a device for vacuuming dust. More specifically the invention relates to a dust mop which has vacuum capabilities.

Dust accumulation on furnishings, floorings and walls is a continuous problem. The problem must be addressed on almost a daily basis in order to be kept under control. If the dust accumulates, the premises will be unsightly as well as unsanitary. The dust is also a health risk in that it can cause allergic response in the eyes, nose and throat. The dust is also a harbor for microorganisms such as bacteria and dustmites.

The conventional method for dealing with dust ccumulation is the typical vacuum cleaner. The vacuum cleaner is very effective at removing dust from furnishings, walls and floors. The problem with the vacuum cleaner is that it is a bulky item. To clean all of the rooms of a premises requires the need to carry around or roll the heavy machinery from room to room. This can be an almost impossible task for many people such as the elderly. In addition, cleaning with a vacuum cleaner can be extremely tedious in the way that cleaning different surfaces requires many different attachments to be placed onto the vacuum device.

A device commonly used to combat dust collection which does not include the inherent problems of a vacuum cleaner is a dust mitten or feather duster. These devices are hand held and can be stroked over furniture or other surfaces in order to trap dust on its exterior. Such devices, however, are extremely inefficient in that the only way the dust is removed is by the frictional adherence of the dust to the mitten or duster. This is very inefficient and results in removing the dust from one area, sending it airborne and depositing it in another.

A hand held vacuum cleaner such as the 'Dustbuster', which is a trademarked name of the Black and Decker Company is another common source of combating dust accumulation. The hand held unit alleviates the problem associated with the vacuum cleaner, but cannot be used efficiently on such items as furniture There exists the need for an apparatus for combating dust accumulation which combines the positive attributes of the above mentioned units without the limitations associated with each one.

While these units may be suitable for the particular purpose employed, or for general use, they would not be as suitable for the purposes of the present invention as disclosed hereafter.

SUMMARY OF THE INVENTION

It is an object of the invention to produce a lightweight vacuum device which can easily be used to clean a variety of surfaces.

It is a another object of the invention to produce a hand held vacuum device.

It is still another object of the invention to produce a lightweight vacuum device which can be attached to a broom handle in order to easily clean floors and walls.

It is a further object of the invention to produce a hand held vacuum device which efficiently collects dust and does not redistribute it around the premises.

The invention is a lightweight vacuum device to be used on furnishings, floors and walls. The apparatus consists of a housing having suction slots on four sides and the bottom. A motor device sits within the housing and creates a vacuum which draws dust into the slots. A filter mechanism within the housing traps the dust for subsequent removal from the housing. The housing is covered by a soft cloth cover as not to scratch the surfaces to be cleaned. The cover has a plurality of holes on the side and bottom in order to allow the dust particles to access the suction slots and an internally sewed glove to allow the unit to be hand held. An appenditure on the top of the housing has internal threads in order to accept a broom handle to allow the unit to be easily used on floors and walls.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
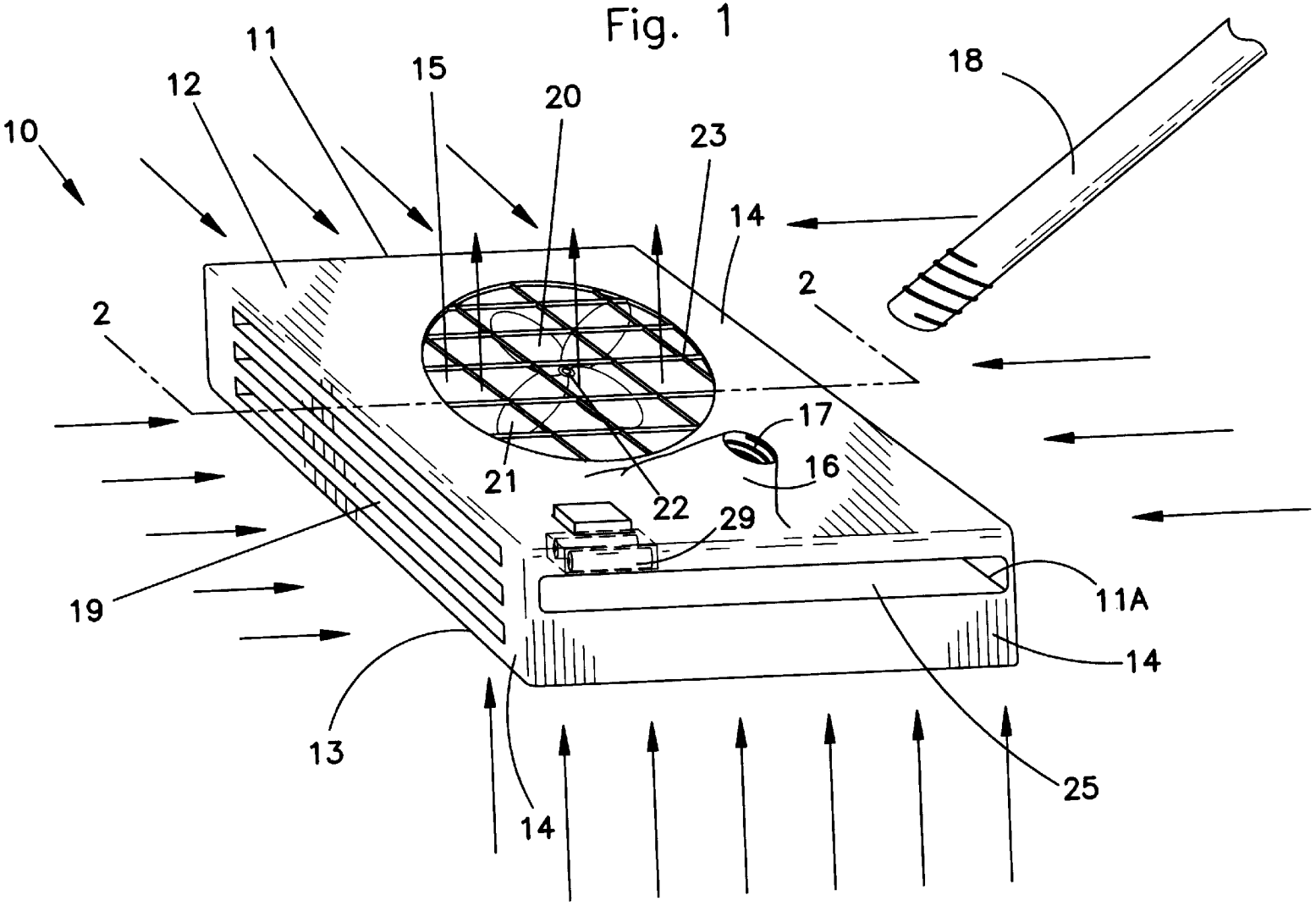
FIG. 1 is an illustration of the main components of the present invention.

FIG. 1 illustrates a lightweight vacuum device 10 having a housing 11, the housing 11 has a top 12, a bottom 13, four sides 14 and an interior 15. The top 12 of the housing 11 has an external cylindrical appenditure 16 which has an internal threaded bore 17. The bore 17 is capable of mating with a standard threaded broom handle 18. This allows the user to operate the vacuum device 10 without having to kneel or bend. The bottom 13 and the four sides 14 have a plurality of suction slots 19 which allows dust to enter the housing 11.

Supported within the housing is a turbine 20 which comprises fan blades 21 attached to a shaft 22. The fan blades 21 rotate and create a vacuum which draws the contacted dust into the suction slots 19. The top 12 of the housing 11 has a plurality of exhaust slots 23 to provide a point of discharge for the exhaust air.

Figure 2:
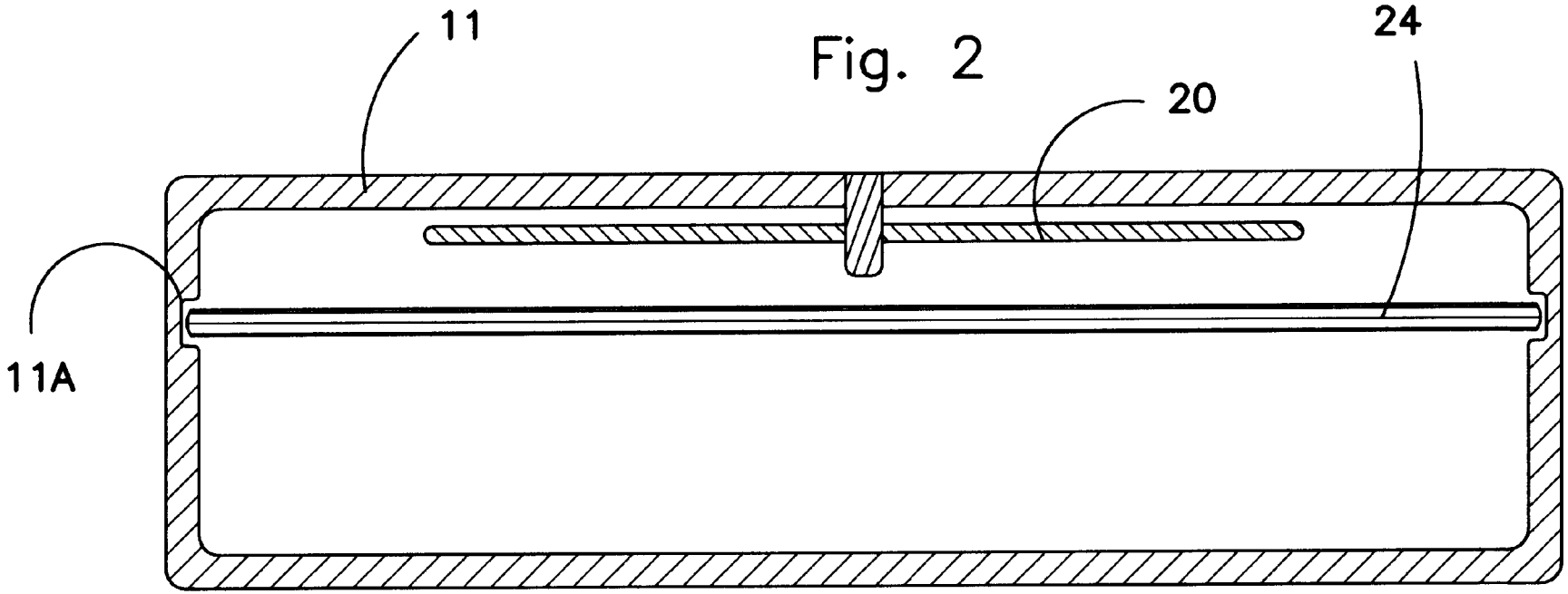
FIG. 2 is a cross sectional view of the present invention taken on line 2—2 of FIG. 1.

Located within the housing 11 is a filter 24, as illustrated in FIG. 2, for trapping dust drawn into the housing 11 by the turbine 20. The housing 11 has an internal groove 11A for holding the filter 24 in place at a point above the suction slots 19 and below the turbine 20. One side 14 has an opening 25 to remove the filter 24. The vacuum device preferably has a self contained power system such as a battery 29.

FIG. 2 is a cross sectional view of the present invention taken along line 2—2 of FIG. 1. Illustrated is the housing 11, the internal groove 11A, the filter 24, and the turbine 20.

Figure 3:
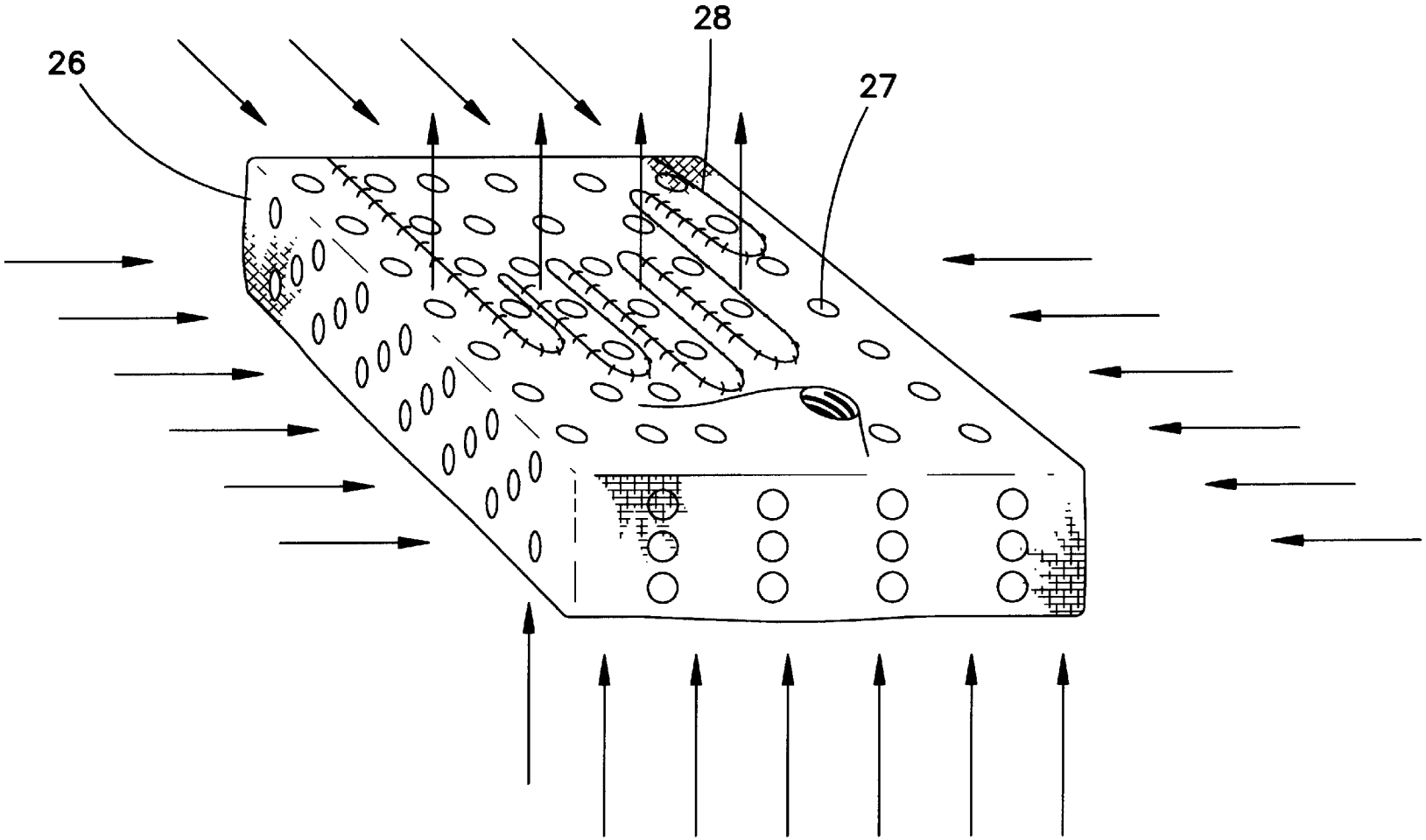
FIG. 3 is an illustration of the present invention covered with the dust cover.

FIG. 3 shows the device enclosed in a cloth cover 26. The cover 26 has a plurality of holes 27 on each surface to allow the contacted dust to enter the suction slots 19 and the exhaust to discharge the exhaust slots 23. The cloth is made of a soft material as to not scratch the surface of the object to be cleaned. This makes the apparatus suitable to be use on hard wood floors and fine furniture. In the preferred embodiment of the invention, the cloth has an I internally sewn glove 28 which can accommodate the hand of a user to make the device a hand held cleaner.

What is claimed is:

1. A vacuum cleaning device comprising:

a housing having a top, a bottom, four sides, and an interior, the bottom and four sides having suction slots, the top having exhaust slots and an appenditure with internal threads for accepting a broom handle;

a turbine comprising blades attached to a shaft which are supported in the housing for rotation to create a vacuum whereby dust is drawn into the vacuum slots;

a filter mechanism for trapping dust entering the housing through the suction slots, the filter mechanism positioned below the turbine and above the suction slots and fitting within an internal ridge on the interior of the housing;

a cloth dust cover extending over the housing, the cover having a plurality of holes on each surface to allow dust to enter the covered suction slots and exhaust to leave the exhaust slots;

a power mechanism to energize the turbine.

2. The vacuum cleaning device as recited in claim 1 wherein the dust cover has an internally sewn glove to convert the device into a hand held cleaner.

3. The vacuum cleaning device as recited in claim 1 wherein the power mechanism is a self contained battery.

* * * * *